US011871783B2

(12) United States Patent
Pikowski

(10) Patent No.: US 11,871,783 B2
(45) Date of Patent: Jan. 16, 2024

(54) PORTABLE CAP CONFIGURED TO CRADLE AND EXTINGUISH LIT CIGARS

(71) Applicant: Daniel M. Pikowski, Bolingbrook, IL (US)

(72) Inventor: Daniel M. Pikowski, Bolingbrook, IL (US)

( * ) Notice: Subject to any disclaimer, the term of this patent is extended or adjusted under 35 U.S.C. 154(b) by 326 days.

(21) Appl. No.: 17/158,686

(22) Filed: Jan. 26, 2021

(65) Prior Publication Data

US 2022/0232887 A1 Jul. 28, 2022

(51) Int. Cl.
*A24F 13/22* (2006.01)

(52) U.S. Cl.
CPC ..... *A24F 13/22* (2013.01)

(58) Field of Classification Search
CPC ..... A24F 19/14; A24F 13/18; A24F 19/00; A24F 13/02; A24F 13/16; A24F 21/00
See application file for complete search history.

(56) References Cited

U.S. PATENT DOCUMENTS

| | | | | |
|---|---|---|---|---|
| 780,465 | A | 1/1905 | Woods | |
| 1,320,037 | A | 10/1919 | Davis | |
| 1,643,703 | A | 9/1927 | Davenport | |
| 2,310,515 | A * | 2/1943 | Chester | A61J 9/06 248/102 |
| 4,907,604 | A * | 3/1990 | Beloff | A24F 13/18 131/238 |
| 7,661,431 | B1 | 2/2010 | Barrios | |
| 8,905,039 | B2 | 12/2014 | Miller | |
| 2001/0048012 | A1 | 12/2001 | Ferrari | |
| 2021/0052000 | A1 * | 2/2021 | Avedissian | A24F 19/14 |

* cited by examiner

*Primary Examiner* — Kelly M Gambetta
*Assistant Examiner* — Stephanie Lynn Moore
(74) *Attorney, Agent, or Firm* — MARSHALL, GERSTEIN & BORUN LLP

(57) ABSTRACT

A cap that can be placed on the lit end of a cigar causes the cigar to be extinguished and subsequently securely held. The cigar is extinguished through the use of a metallic cap and/or a metallic insert embedded or otherwise attached to the cap. The cap cradles a cigar through use of a holding mechanism comprised of springs and/or tabs. A magnet attached to the cap allows the cap to be placed on a variety of straight or sloped surfaces and still safely hold a cigar that has been inserted into the cap.

8 Claims, 7 Drawing Sheets

PORTABLE CAP CONFIGURED TO CRADLE AND EXTINGUISH LIT CIGARS

FIELD OF THE INVENTION

The disclosure generally relates to a device for safely and securely capping, holding, and extinguishing lit cigars.

BACKGROUND

Cigars are, in the modern era, a luxury good often smoked by people as a recreational activity. However, they tend to be somewhat unwieldly and—given their inherent connection with fire—dangerous if not handled properly. This limits the manner in which an individual can use cigars, drastically reducing the number of activities alongside which a cigar can be enjoyed. Fishing, golfing, and other recreational activities that require two hands, then, are unable to be fully appreciated alongside a cigar.

Others have attempted to solve this problem to varying degrees of success. However, each of these solutions has glaring flaws that lead to a less-than-perfect product. A number of these products are unwieldly and difficult to transport. Other solutions known in the art require particularly shaped or formed objects to be effective, such as a bar upon which to clamp the product. Still others allow ash to scatter freely—causing at best a mess and more likely a dangerous situation—or fail to extinguish the cigar, allowing it to burn to a stub and wasting an expensive good.

The device described in the disclosure below aims to solve these long-standing problems through use of a single, portable device.

SUMMARY

One exemplary embodiment includes a cap for securely cradling and extinguishing cigars. The cap may comprise: (i) a cap shell made of a metallic material to fit the end of a cigar, wherein: (a) the cap shell has an open end and a closed end, (b) the cap shell has one or more cut-outs formed proximate the open end, (c) the metallic material is flame-resistant and non-combustible, and (d) the cap shell is configured such that, when placed on a lit cigar, the cigar is extinguished; (ii) at least one spring coiled around a segment of the cap shell between the open end of the cap shell and the one or more cut-outs; and (iii) a magnet attached to the cap shell.

Another exemplary embodiment includes a cap for securely cradling and extinguishing cigars. The cap may comprise: (i) a cap shell made of a nonmetallic material to fit the end of a cigar, the cap shell having an open end and a closed end; (ii) at least one tab configured such that it protrudes from an interior wall of the cap shell; (iii) a fire-resistant and non-combustible metallic insert attached to an interior of the closed end of the cap shell, configured such that, when placed on a lit cigar, the cigar is extinguished; and (iv) a magnet attached to the cap shell.

Advantages will become more apparent to those skilled in the art from the following description of the preferred embodiments, which have been shown and described by way of illustration. As will be realized, the present embodiments may be capable of other and different embodiments, and their details are capable of modification in various respects. Accordingly, the drawings and description are to be regarded as illustrative in nature and not as restrictive.

BRIEF DESCRIPTION OF THE DRAWINGS

The Figures described below depict various aspects of the device disclosed herein. It should be understood that each figure depicts a particular aspect of the disclosed device, and that each of the Figures is intended to accord with a possible aspect thereof. Further, wherever possible, the following description refers to the reference numerals included in the following Figures, in which features depicted in multiple Figures are designated with consistent reference numerals.

There are shown in the Figures arrangements which are presently discussed, it being understood, however, that the present embodiments are not limited to the precise arrangements and instrumentalities shown, wherein.

The Figures depict preferred embodiments for purposes of illustration only. Alternative embodiments of the devices illustrated herein may be employed without departing from the principles of the invention described herein.

DETAILED DESCRIPTION

Various embodiments of the present disclosure include a cap that stabilizes and cradles a cigar by way of one or more springs coiled through cut-outs in the cap shell and a cap that stabilizes and holds a cigar in place by way of one or more tabs extending from an interior wall of the cap shell. The cap may also be configured such that, when placed on the lit end of a cigar, the cigar is extinguished by a metallic shell of the cap and/or by a metallic insert attached to the interior of the cap shell. Various embodiments of the present disclosure also include a magnet attached to the shell of the cap, allowing the cap to be placed at a variety of angles on appropriate surfaces and still securely cradle a cigar. By providing a cap that can be used to safely and securely cradle and extinguish cigars, the present disclosure addresses the long-felt need for a device that allows for a safe, quick, and secure method of putting down, extinguishing, and preserving a cigar.

Although the following text sets forth a detailed description of numerous different embodiments, it should be understood that the legal scope of the description is defined by the words of the claims set forth at the end of this patent and equivalents. The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

Portable Cap for Extinguishing Cigars Using a Spring-Based Cradling Method

Figure 1:
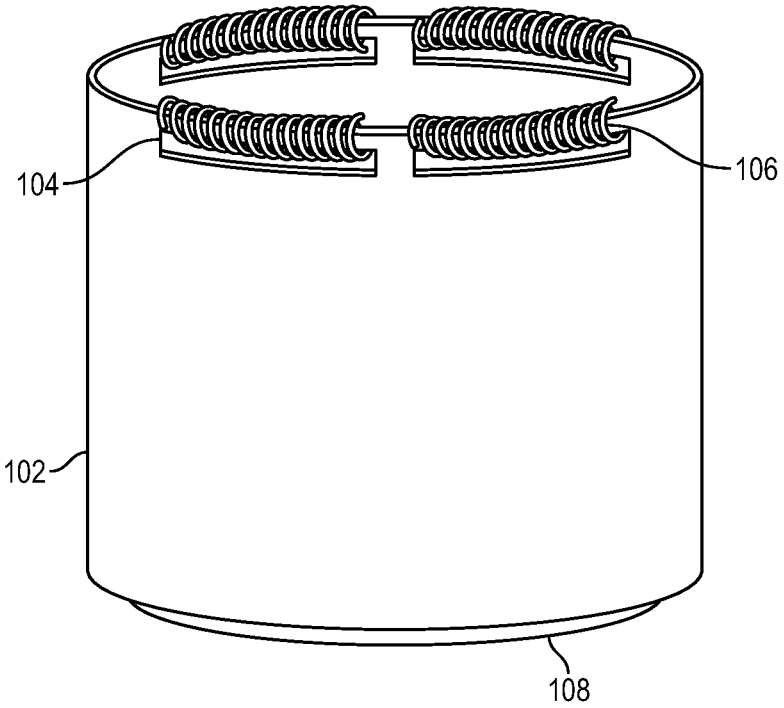
FIG. 1 illustrates a front view of an exemplary metallic cap with springs designed to cradle and stabilize a cigar.

FIG. 1 illustrates a front view of an exemplary metallic cap 100 with springs designed to cradle and hold a cigar in place. In one embodiment, the exemplary device 100 is comprised of at least a cap shell 102. The cap shell 102 acts as the main body of the cap 100 and can, depending on the embodiment, be made of a variety of different materials. In some embodiments, the cap shell 102 is metallic, fire-resistant, and non-combustible, allowing the cap 100 to be safely placed on a lit cigar. When the cap shell 102 is placed against the lit end of a cigar, the cigar is extinguished. In some implementations, the cigar is extinguished due to oxygen deprivation.

In further embodiments, the cap shell 102 has an open end and a closed end, such that a cigar can be inserted into the cap shell 102. Depending on the embodiment, the cap shell 102 may cover up to 100% of the cigar when the cigar is inserted into the cap shell 102. Depending on the embodiment, the cap shell 102 can be shaped to fit the diameter of any size of cigar. In some implementations, the cap shell 102 fits a cigar when the open end of the cap shell 102 is no more than 10% larger than the diameter of the cigar.

In some embodiments, the cap shell 102 is shaped similarly to a cylinder. In further embodiments, the cap shell 102 may be shaped differently (e.g., shaped as a rectangular prism). In such embodiments, the cap shell 102 may have a cylindrical chamber into which a cigar is inserted.

In the exemplary embodiment of the cap 100, the cap shell 102 is configured such that one or more cut-outs 104 are formed in the cap shell 102. In some embodiments, the cut-outs 104 are proximate to the open end of the cap shell 102. In some implementations, the cut-outs 104 run parallel to the open end of the cap shell 102 and may substantially surround the circumference of the cap shell 102. In further implementations, the cut-outs 104 run perpendicular to the open end of the cap shell 102.

In the exemplary embodiment of the cap 100, the cap 100 further includes at least one spring 106. Depending on the embodiment, the spring 106 may surround substantially the entire circumference of the cap shell 102 or may be limited to a single cut-out 104. The spring 106 is coiled in such a way that, when a cigar is placed into the cap 100, the spring 106 is capable of expanding so as to allow insertion. The spring 106 then tightens around the cigar. This tightening cradles the cigar, holding both the cigar and cap 100 in place and preventing the cigar and cap 100 from separating without an application of force.

In some embodiments, the spring 106 coils around a strip of the cap shell 102 separating it from the open end of the cap shell 102. In further embodiments, there exist two cut-outs 104 for each spring 106, and each spring 106 is coiled around a portion of the cap shell 102 that separates two cut-outs.

The size of the springs 106 may vary between different implementations. Similarly, how closely the springs 106 are wound to the walls of the cap shell 102 may vary between implementations. In some embodiments, the distance across the interior of the cap shell 102 and between the springs is no more than 10% smaller than the diameter of the cigar to be inserted.

In the exemplary embodiment of the cap 100, the cap 100 further includes a magnet 108. Depending on the embodiment, the magnet 108 may be attached to either the exterior or interior of the cap shell 102. In some implementations, the magnet 108 is attached to the cap shell 102 by an adhesive substance. In further implementations, the magnet 108 is built into the cap shell 102. In implementations in which the cap shell 102 is ferrous, the magnet 108 may be attached to the cap shell 102 magnetically.

In some implementations, the magnet 108 is attached to the exterior of the closed end of the cap shell 102. In other implementations, the magnet 108 is attached to the exterior of the cap shell 102 along the circumference of the cap shell 102. Depending on the embodiment, the magnet 108 along the circumference of the cap shell 102 may be placed at one location on the side of the cap shell 102 or may surround the entire circumference as a ring. In further implementations, the magnet 108 may be placed in a constructed chamber in the cap shell 102 such that the magnet 108 cannot be removed and/or seen without deconstructing the cap 100.

Figure 2:
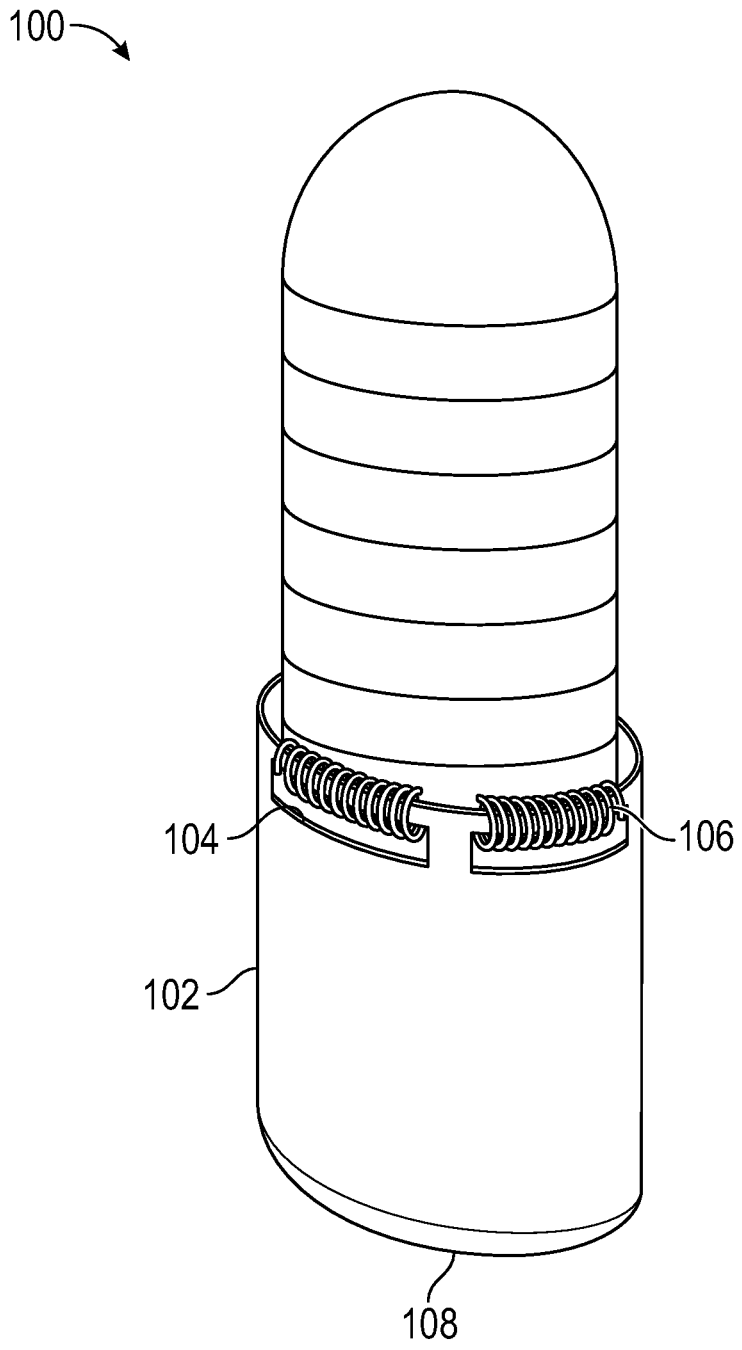
FIG. 2 illustrates an isometric view of an exemplary metallic cap with springs designed to cradle and stabilize a cigar.

FIG. 2 illustrates an isometric view of an exemplary cap 100 with springs designed to cradle and hold a cigar in place. The cap 100 of FIG. 2 is comprised of at least a cap shell 102, one or more cut-outs 104, one or more springs 106, and a magnet 108. The cap shell 102 may be made of a metallic, fire-resistant, non-combustible material. The cap shell 102 also has at least one cut-out 104 and at least one magnet 108 attached to the cap shell 102.

The one or more springs 106 are wound through the at least one cut-out 104. In some embodiments, the springs 106 expand when met with pressure, allowing the cap 100 to be placed on a cigar. Similarly, the springs 106 may then attempt to return to an original state, tightening around the inserted cigar. The pressure from the springs 106 cradles the cigar and may hold the cigar in place, allowing it to remain steady even when the cap 100 is tilted or turned.

Figure 3:
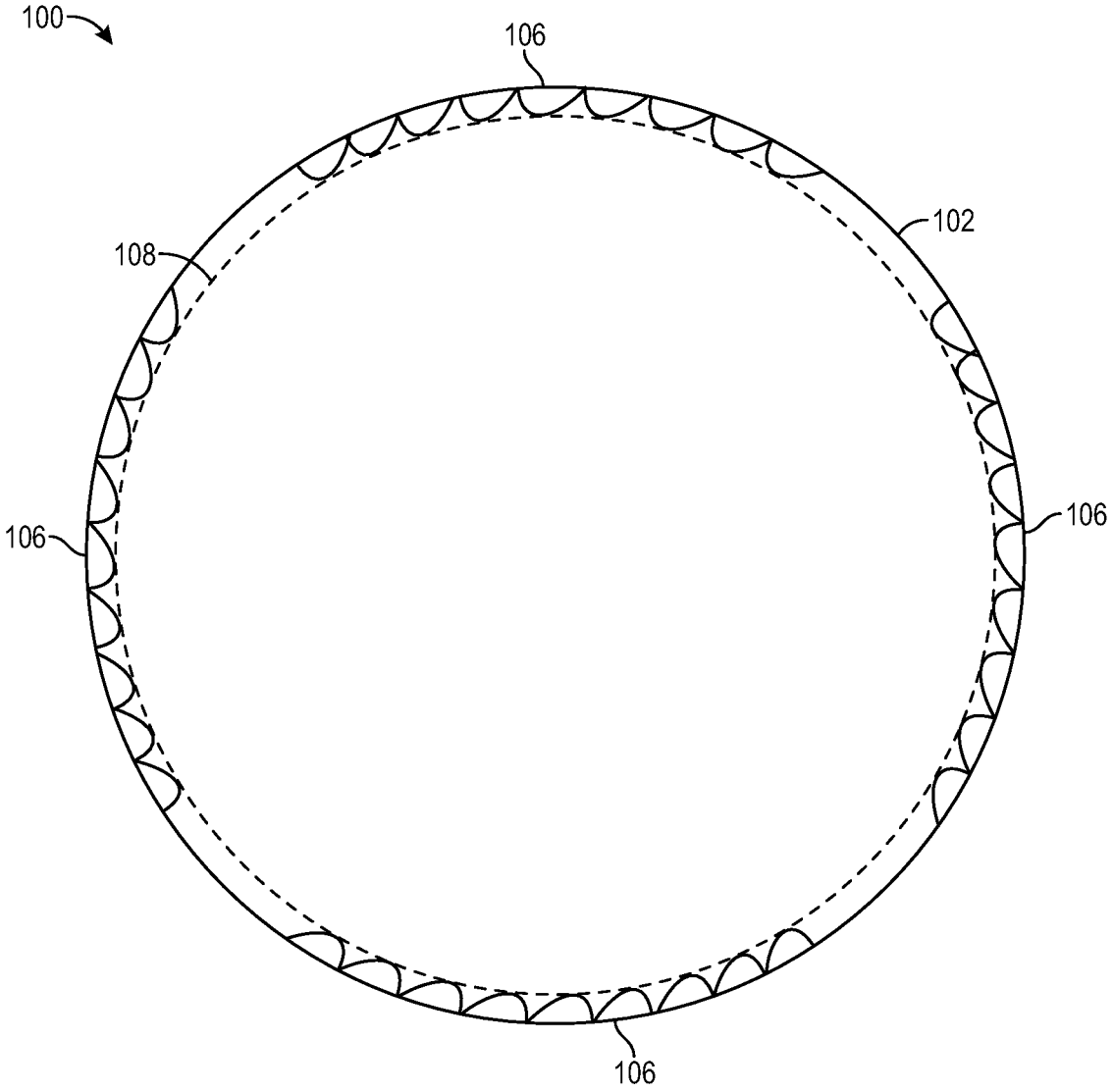
FIG. 3 illustrates a top-down view of an exemplary metallic cap with springs designed to cradle and stabilize a cigar.

FIG. 3 illustrates a top-down view of an exemplary metallic cap 100 with springs 106 designed to cradle and hold a cigar in place. The cap 100 has a metallic, fire-resistant, non-combustible cap shell 102. The cap also includes one or more springs 106 wound through at least one cut-out (not shown).

In some embodiments, a magnet 108 is attached to the exterior of the cap shell 102. In further embodiments, the magnet 108 is attached to the exterior of the closed end of the cap shell 102. Depending on the implementation, the magnet 108 may cover some to substantially all of the closed end of the cap shell 102. Further, the magnet 108 may be a neodymium magnet, samarium cobalt magnet, alnico magnet, ceramic magnet, ferrite magnet, or any other type of permanent magnet.

As an example depiction, consider the following cap. The cap is comprised of a cap shell made of aluminum, three springs, and a ceramic magnet. The cap shell is cylindrical and has a closed end and an open end, each with a diameter of one and one-eighth inches. The cap shell extends one and one-half inches between the closed end and the open end. The cap also has three cut-outs proximate to the open end of the cap shell, each of equal length and spaced evenly along the circumference. Each spring is wound around the strip of cap shell separating each cut-out from the open end of the cap shell and extends one-eighth of an inch towards the center of the open end. The ceramic magnet is attached to the closed end of the exterior of the cap shell. The ceramic magnet is one inch in diameter, covering most of the closed end of the cap shell, and is centered on the closed end of the cap shell.

The cap can be placed on the lit end of a lit cigar with a diameter of one inch. When the cap is placed on the cigar, it comes into contact with the springs, as the springs create an effective diameter of seven-eighths of an inch for the open end of the cap. When the cigar comes into contact with and exerts pressure upon the springs, the springs expand by at least one-sixteenth of an inch each, allowing the cigar to be inserted. The cap is pressed firmly onto the cigar, causing the cigar to be extinguished due to pressure and oxygen deprivation. The springs attempt to return to a natural state, tightening around the cigar. The cap can then be placed on a ferrous metallic surface to hold the cigar while the user has easy use of both hands. The cap can be placed on a flat surface or on an angled surface.

Portable Cap for Extinguishing Cigars Using a Tab-Based Cradling Method

Figure 4:
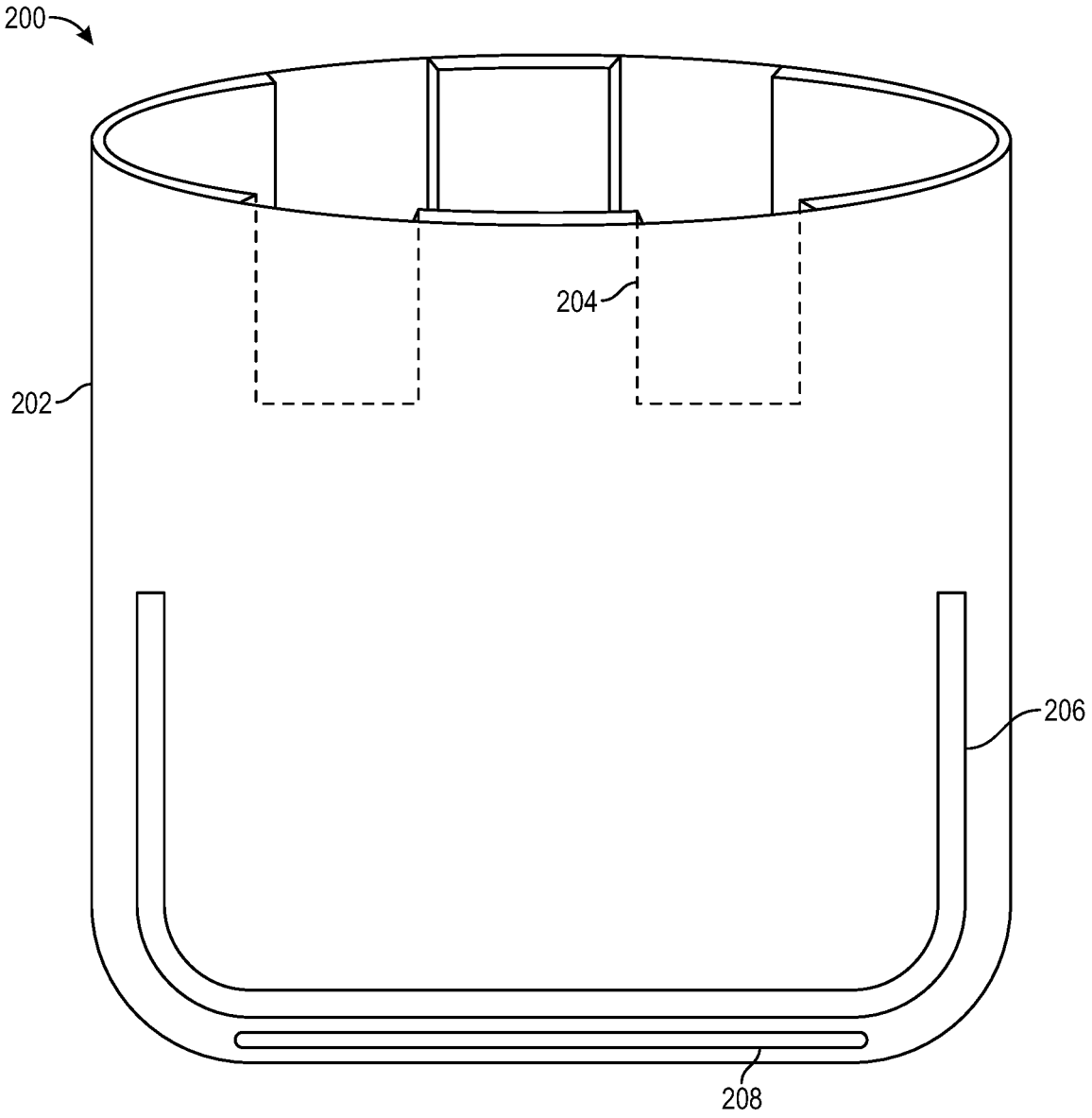
FIG. 4 illustrates a front view of an exemplary nonmetallic cap with tabs biased to stabilize a cigar and a metallic insert to extinguish the cigar.

FIG. 4 illustrates a front view of an exemplary cap 200 with tabs 204 biased to stabilize and hold a cigar in place and a metallic insert 206 to extinguish the cigar. In one embodiment, the cap 200 is comprised of at least a cap shell 202. The cap shell 202 acts as the main body of the cap 200 and can, depending on the embodiment, be made of a variety of different materials. Depending on the embodiment, the cap 200 can be made of metallic or nonmetallic material.

In further embodiments, the cap shell 202 has an open end and a closed end, such that a cigar can be inserted into the cap shell 202. Depending on the embodiment, the cap shell 202 may cover up to 100% of the cigar when the cigar is inserted into the cap shell 202. Depending on the embodiment, the cap shell 202 can be shaped to fit the diameter of any size of cigar. In some implementations, the cap shell 202 fits a cigar when the diameter of the open end of the cap shell 202 is no more than 10% larger than the diameter of the cigar.

In the exemplary embodiment of the cap 200, the cap shell 202 is configured such that one or more tabs 204 extend inwards towards the center of the cap shell 202. In some embodiments, the tabs are formed from cap shell 202, and thus are attached to the cap shell 202 as part of one, seamless whole. In further embodiments, the tabs are made separately from either the same or a different material and are attached to the cap shell 202 through the use of an adhesive, a bonding agent, grooves and slots, and/or any other technique known in the art.

In some embodiments, the tabs 204 are biased inwards such that a cigar can be inserted into the cap 200 and be held securely in place. The tabs 204 are designed to bend and/or be pushed backwards by a cigar such that the cigar can be inserted into the cap 200. The tabs 204 then, being biased towards the original shape and/or position, exert force on the cigar as the tabs 204 attempt to return to the original shape and/or position. In some implementations, the tabs 204 are sufficiently elastic so as to allow the cigar to be removed with an application of force by bending upwards. In further implementations, the tabs 204 have rounded edges so as to allow the cigar to be removed without damage.

Though the description above discusses tabs 204 in the plural, the cap 200 in some embodiments may also have a singular tab 204. In some implementations, the tab 204 is shaped like a ring and covers substantially all of the circumference of the interior wall of the cap shell 202. In other implementations, the singular tab 204 may be large enough and/or exert sufficient force that a cigar may be held in place by the singular tab 204 pushing the cigar up against the interior wall of the cap shell 202 and/or metal insert 206.

Similarly, though the tabs 204 are depicted as being immediately proximate to the open end of the cap shell 202 in the exemplary embodiment of FIG. 4, the tabs 204 may be located anywhere on the interior of the cap shell 202.

In the exemplary embodiment of the cap 200, the cap 200 is further comprised of a metallic insert 206. The metallic insert 206 is fire-resistant and non-combustible, allowing the cap 200 to be safely placed on a lit cigar. In some embodiments, the metallic insert 206 is attached to the interior of the closed end of cap shell 202. In further embodiments, the metallic insert 206 is also attached to the interior walls of the cap shell 202. In some implementations, the metallic insert 206 is attached to the cap shell 202 through the use of an adhesive and/or a bonding agent. In further implementations, the metallic insert 206 is attached to the cap shell through grooves or slots built-in to the cap shell 202. In still further implementations, the metallic insert 206 is ferrous and is attached to the cap shell 202 by means of a magnet.

As the metallic insert 206 is fire-resistant and non-combustible, it can be safely placed against the lit end of a cigar. When the metallic insert 206 attached to the cap shell 202 is placed against the lit end of a cigar, the cigar is extinguished. In some implementations, the cigar is extinguished due to oxygen deprivation.

In the exemplary embodiment of the cap 200, the cap 200 further includes a magnet 208. Depending on the embodiment, the magnet 208 may be attached to either the exterior or interior of the cap shell 202. In some embodiments, the magnet 208 is attached to the cap shell 202 by an adhesive substance. In further embodiments, the magnet 208 is built into the cap shell 202.

In some implementations, the magnet 208 is attached to the exterior of the closed end of the cap shell 202. In other implementations, the magnet 208 is attached to the exterior of the cap shell 202 along the circumference of the cap shell 202. Depending on the embodiment, the magnet 208 along the circumference of the cap shell 202 may be placed at one location on the side of the cap shell 202 or may surround the circumference as a ring. In further implementations, the magnet 208 may be placed in a constructed chamber in the cap shell 202 such that the magnet 208 cannot be removed and/or seen without deconstructing the cap 200.

Figure 5:
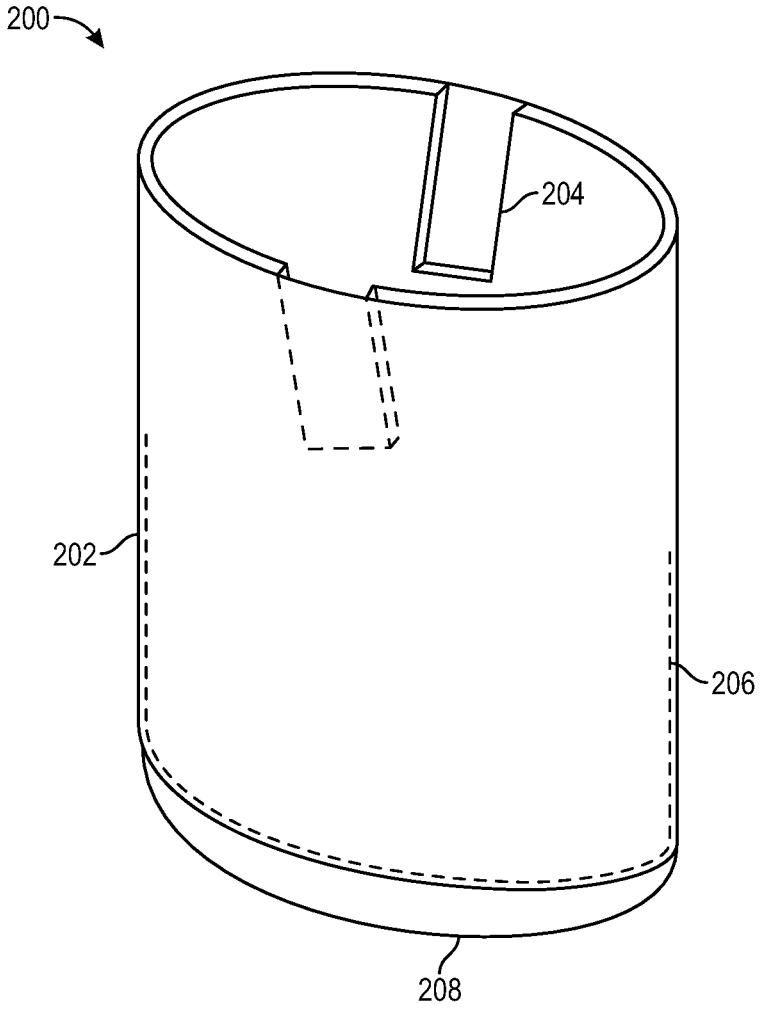
FIG. 5 illustrates an isometric view of an exemplary nonmetallic cap with tabs biased to stabilize a cigar and a metallic insert to extinguish the cigar.

FIG. 5 illustrates an isometric view of an exemplary nonmetallic cap 200 with tabs 204 biased to stabilize and hold a cigar in place and a metallic insert 206 to extinguish the cigar. The cap 200 of FIG. 5 is comprised of at least a cap shell 202, one or more tabs 204, a metallic insert 206, and a magnet 208. The cap shell 202 may be made of a nonmetallic material. In some embodiments, the cap shell 202 may be fire-resistant and non-combustible.

The one or more tabs 204 extend out from the interior wall of the cap shell 202. Depending on the embodiment, the tabs 204 may extend out to up to 50% of the diameter of the open end of the cap shell 202. In embodiments with a single tab 204, the tab 204 may extend out to the length of the diameter of the open end of the cap shell 202. In a neutral state with no cigar, the tabs 204 may be biased inward at an angle of up to ninety degrees from the interior wall of the cap shell 202.

Figure 6:
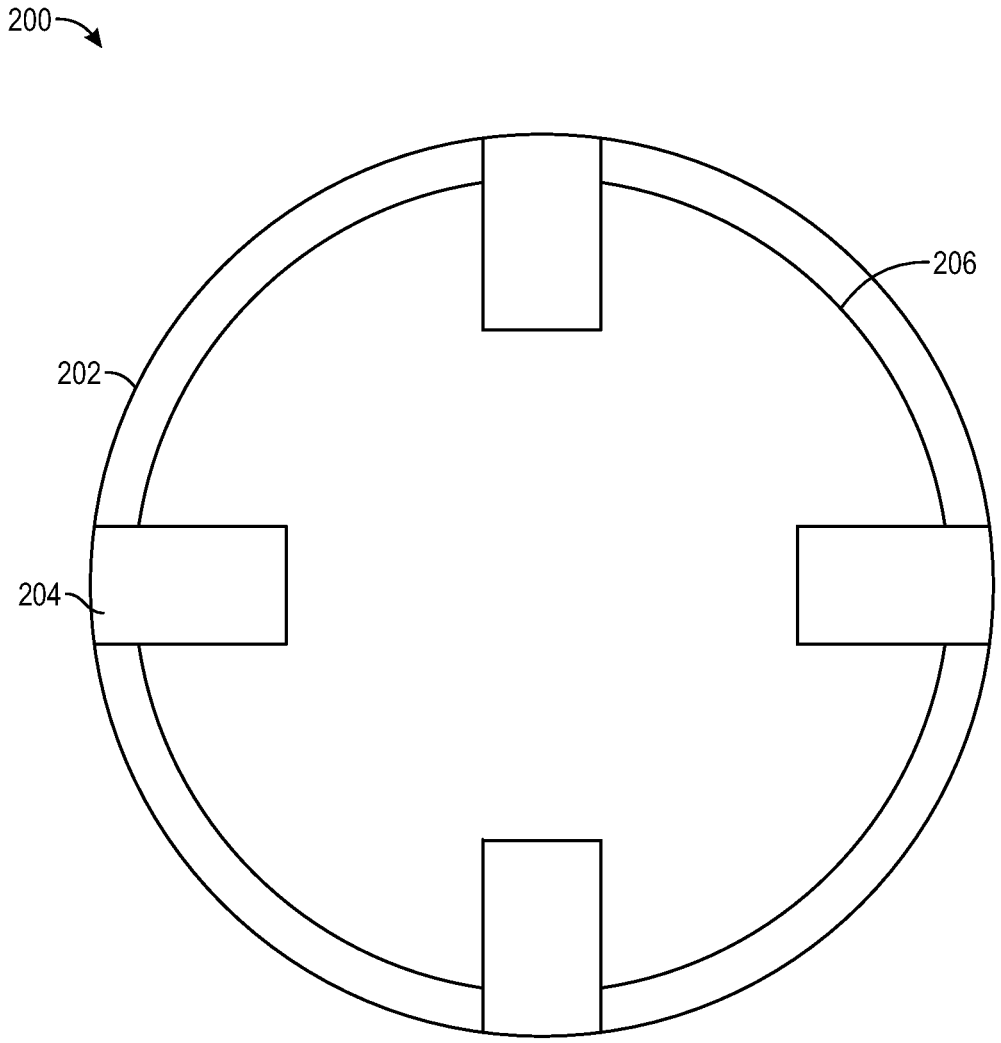
FIG. 6 illustrates a top-down view of an exemplary nonmetallic cap with tabs biased to stabilize a cigar and a metallic insert to extinguish the cigar.

FIG. 6 illustrates a top-down view of an exemplary nonmetallic cap 200 with tabs 204 biased to stabilize and hold a cigar in place and a metallic insert 206 that causes the cigar to be extinguished when the cap 200 is placed on the lit end of the cigar. The cap 200 has a nonmetallic cap shell 202. The cap also includes one or more tabs 204 and a magnet (not shown).

In some embodiments, the cap 200 has a metallic insert 206. The metallic insert 206 is made of a metallic, fire-resistant, non-combustible material. The metallic insert 206 is attached to the interior of the cap shell 202. In some embodiments, the metallic insert 206 is attached to the interior of the closed end of the cap shell. In various implementations, the metallic insert covers some to all of the closed end of the cap shell 202. In further embodiments, the metallic insert 206 covers the entirety of the closed end of the cap shell 202 and extends upwards to cover some to all of the interior wall of the cap shell 202. In some implementations, the metallic insert 206 is made from the same material throughout. The metallic insert 206 may also be made of a mixture of materials.

Depending on the embodiment, the metallic insert 206 may be attached to the cap shell 202 in different ways. In one embodiment, the metallic insert 206 is attached to the cap shell 202 through the use of an adhesive or bonding agent. In further embodiments, the metallic insert 206 is attached to the cap shell 202 by slotting in to the cap shell 202 or through otherwise permanently attaching the cap shell 202 to the metallic insert 206. This may be accomplished during the initial manufacturing of the cap shell 202 or at any point thereafter. In still further embodiments, the metallic insert 206 is attached to the cap shell 202 by way of an embedded magnet. Depending on the implementation, this may be the magnet 208 or it may be a separate magnet.

Figure 7A:
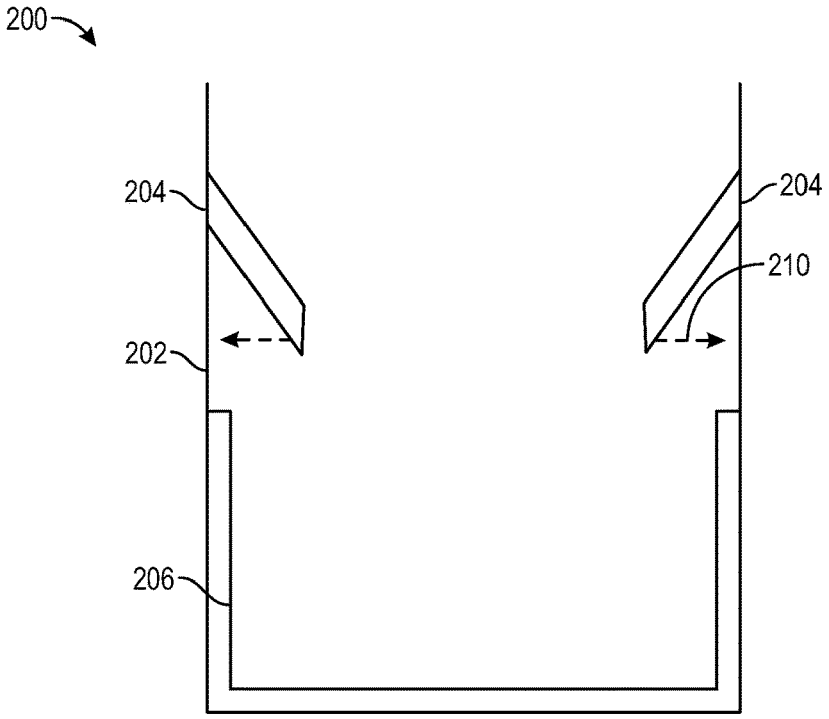
FIG. 7A illustrates an exemplary interior to a nonmetallic cap with tabs biased to stabilize a cigar and a metallic insert to extinguish the cigar.
Figure 7B:
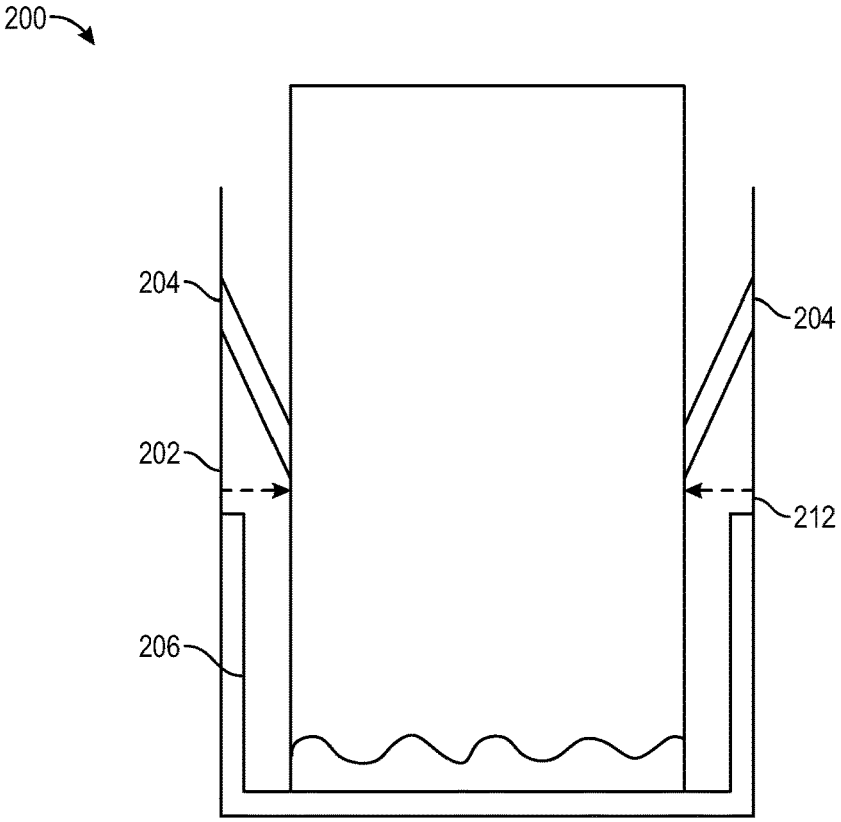
FIG. 7B illustrates an exemplary interior to a nonmetallic cap with a cigar inserted, illustrating an exemplary movement of the tabs biased to stabilize a cigar.

FIG. 7A illustrates an exemplary interior to a nonmetallic cap 200 with tabs 204 biased to stabilize and hold a cigar in place and a metallic insert 206 to extinguish the cigar. FIG. 7B illustrates an exemplary interior to the same nonmetallic cap 200 with a cigar inserted, depicting an exemplary movement of the tabs 204 biased to hold a cigar in place.

Together, FIGS. 7A&B depict an exemplary embodiment of a nonmetallic cap 200 and particularly of how tabs 204 may move in order to allow the cap 200 to be placed on a cigar. Further, FIGS. 7A&B depict how the tabs 204 subsequently exert pressure to keep the cigar held securely in the cap 200. In some embodiments, the tabs 204 have pressure 210 placed on them, causing them to move towards the walls of the cap shell 202. This pressure may be due to a cigar being inserted or may be due to a crank, spring, or other similar mechanism moving them toward the interior wall of the cap shell 202. In further embodiments, the tabs 204 exert pressure 212 back onto the cigar once the cigar has been inserted into the cap 200. In some implementations, the tabs 204 begin exerting pressure 212 on the cigar immediately upon insertion. In further implementations, the tabs 204 are released after the cigar has been fully inserted and the tabs 204 begin exerting pressure 212 against the cigar.

ADDITIONAL CONSIDERATIONS

All of the foregoing devices may include additional, less, or alternate functionality, including that discussed herein. The following additional considerations apply to the foregoing discussion. Throughout this specification, plural instances may implement components, operations, or structures described as a single instance. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the description. This description, and the claims that follow, should be read to include one or at least one and the singular also includes the plural unless it is obvious that it is meant otherwise.

The patent claims at the end of this patent application are not intended to be construed under 35 U.S.C. § 112(f) unless traditional means-plus-function language is expressly recited, such as "means for" or "step for" language being explicitly recited in the claim(s).

This detailed description is to be construed as exemplary only and does not describe every possible embodiment, as describing every possible embodiment would be impractical, if not impossible. One may implement numerous alternate embodiments, using either current technology or technology developed after the filing date of this application.

What is claimed is:

1. A cap for securely holding and extinguishing cigars, comprising:

a cap shell made of a metallic material to fit the end of a cigar, wherein:

the cap shell has an open end and a closed end, the cap shell has one or more cut-outs formed proximate the open end, the metallic material is flame-resistant and non-combustible, and the cap shell is configured such that, when placed on a lit cigar, the cigar is extinguished;

at least one spring coiled through at least one of the one or more cutouts and around a segment of the cap shell between the open end of the cap shell and the one or more cut-outs; and a magnet attached to the cap shell.

2. The cap of claim 1, wherein the at least one spring is configured such that it can expand to allow the cigar to be inserted and can tighten to hold the cigar in place.

3. The cap of claim 1, wherein the cap shell is configured such that, when placed on a lit cigar, the cigar is extinguished by oxygen-deprivation.

4. The cap of claim 1, wherein the magnet is attached to an exterior of the cap shell such that the cap holds the cigar when the magnet is placed on a ferrous metallic surface.

5. The cap of claim 1, wherein the magnet is attached to an interior of the cap shell such that the cap holds the cigar when the cap shell is placed on a ferrous metallic surface.

6. The cap of claim 1, wherein the one or more cut-outs substantially surround a circumference of the cap shell.

7. The cap of claim 1, wherein the cap shell is configured such that a diameter of the open side of the cap shell is no more than 10% greater than a diameter of the cigar.

8. The cap of claim 1, wherein the cap is configured such that:

the cap shell is configured such that:

the cap shell has three cut-outs formed proximate the open end, and the three cut-outs substantially surround a circumference of the cap shell;

three springs are configured such that each spring is coiled around the material separating each cut-out from the open end of the cap shell; and the magnet is attached to the exterior of the closed end of the cap shell.

* * * * *